US005819196A

United States Patent [19]

Holmes et al.

[11] Patent Number: 5,819,196

[45] Date of Patent: Oct. 6, 1998

[54] METHOD AND SYSTEM FOR ADAPTIVE FUEL DELIVERY FEEDFORWARD CONTROL

[75] Inventors: John William Holmes, Eastpointe; Michael John Cullen, Northville, both of Mich.

[73] Assignee: Ford Global Technologies, Inc., Dearborn, Mich.

[21] Appl. No.: 870,053

[22] Filed: Jun. 5, 1997

[51] Int. Cl.[6] ..... F02M 23/00; F02D 43/00

[52] U.S. Cl. ..... 701/103

[58] Field of Search ..... 701/103; 123/458; 364/724.1, 158, 165, 431.04, 116; 179/170.2

[56] References Cited

U.S. PATENT DOCUMENTS

| | | | |
|---|---|---|---|
| 3,473,008 | 10/1969 | Bay et al. | 364/116 |
| 3,632,905 | 1/1972 | Thomas et al. | 179/170.2 |
| 3,699,931 | 10/1972 | Cinquergrani | 123/458 |
| 4,319,320 | 3/1982 | Sato et al. | 364/165 |
| 4,565,173 | 1/1986 | Oshiage et al. | 123/458 |
| 4,982,331 | 1/1991 | Miyazaki | 364/431.04 |
| 5,471,411 | 11/1995 | Adams et al. | 364/724.01 |
| 5,513,098 | 4/1996 | Spall et al. | 364/158 |

*Primary Examiner*—Raymond A. Nelli
*Attorney, Agent, or Firm*—Neil P. Ferraro; Roger L. May

[57] ABSTRACT

A method and system for adaptive feedforward control of a fuel delivery system provides for adapting a normalized pressure input and a normalized flowrate input to a feedforward voltage look-up table. If low fuel flow and high manifold pressure are detected (104), then the normalized pressure input will be adapted based on a target fuel rail pressure and a pressure multiplier PMUL. If high fuel flow is detected (106), then the normalized flowrate input will be adapted based on a target flowrate and a flowrate multiplier FMUL. The present invention provides adaptive feedforward control without the need for the look-up table to be stored in a keep-alive memory (KAM).

20 Claims, 3 Drawing Sheets

METHOD AND SYSTEM FOR ADAPTIVE FUEL DELIVERY FEEDFORWARD CONTROL

TECHNICAL FIELD

The present invention relates to a system and method for adaptively controlling operation of an electrically powered fuel pump to improve fuel delivery to fuel injectors in an internal combustion engine.

BACKGROUND ART

Conventional electronic fuel injection systems use an electronically powered pump to supply fuel to the fuel injectors. The pump is controlled to operate at a constant speed. For newer pumping systems which do not return fuel to the reservoir tank, pressure across the injectors is maintained by modulating the fuel pump. A static, nonadaptive feedforward voltage arrangement can be employed to assist and improve pressure control in delivery systems both with and without injection pressure (IP) sensor feedback. Because static feedforward control arrangements are open loop, i.e., there is no correction of the feedforward response, such feedforward control is typically designed to operate under all applications without consideration of factors such as variations in hardware performance due to manufacturing tolerances, or variations in system performance due to filter clogging. Thus, known static feedforward control arrangements are tailored to assume nominal operating conditions.

In order to overcome the inadequacies of static control arrangements, adaptive feedforward voltage control systems have been devised. Such adaptive systems typically monitor fuel injector pressure and modify the feedforward voltage to match actual fuel delivery performance with desired or target fuel delivery performance. Adaptive feedforward control systems allow a fuel delivery system to be adjusted to accommodate unit-to-unit variability, and degradation due to aging or contamination.

More specifically, feedforward voltage control is determined as a function of a desired fuel pump flow for a given pump or fuel rail pressure. Actual injector pressure is compared with the desired or target injector pressure to determine whether an error is present for delivery of the fuel. The feedforward voltage is typically generated using normalized values for target flow and pressure as inputs for a look-up table stored in a memory. FIGS. 1(*a*) and 1(*b*) show the relationship between the normalized and target values. Each feedforward voltage $V_{RC}$ stored in the look-up table, such as represented in FIG. 2, is constantly adapted or modified in accordance with the detected error in fuel flow delivery.

While such adaptive feedforward control systems have operated satisfactorily, the need to constantly update numerous table entries in the resident memory requires the use of a large keep-alive-memory (KAM) type memory arrangement, where each cell of the KAM must be continually updated. The use of such a memory arrangement increases processing complexity and system cost.

DISCLOSURE OF THE INVENTION

Accordingly, it is an object of the present invention to provide a method and system for adaptive feedforward control of a fuel delivery system having a simplified processing and memory arrangement.

In accordance with a first aspect of the present invention, a method and system are provided for controlling fuel supplied by an electronic fuel pump to at least one fuel injector in an internal combustion engine. The method includes the steps of detecting whether fuel flowrate, or a value representative thereof, to the at least one fuel injector is less than a first predetermined threshold value, or greater than a second predetermined threshold value. The method further includes generating a normalized pressure value and a normalized flowrate value, and determining a fuel pump input voltage based on the normalized pressure value and the normalized flow value, wherein if the first threshold value is not exceeded, a pressure modification value is generated and the normalized pressure value is adapted based on a target pressure value and the pressure modification value. If the second threshold value is exceeded, a flowrate modification value is generated and the normalized flow value is adapted based on a target flowrate value and the flowrate modification value.

In accordance with another aspect of the present invention, the method can further comprise the steps of determining an input voltage for the fuel pump comprises utilizing the normalized pressure and normalized flowrate values as inputs to select a corresponding voltage from a table stored in a memory, and either adjusting the smallest voltage in the table based on the generated pressure modification value if the normalized pressure is too low to select a voltage from the table, or adjusting the largest voltage in the table based on the generated flowrate modification value if the normalized flowrate is too high to select a voltage.

The above object and other objects, features, and advantages of the present invention are readily apparent from the following detailed description of the best mode for carrying out the invention when taken in connection with the accompanying drawings.

BREIF DESCRIPTION OF THE DRAWINGS

FIGS. 1(*a*) and 1(*b*) are graphs illustrating the relationship between normalized rail absolute pressure and target rail absolute pressure, and normalized fuel flow and target fuel flow in a conventional adaptive feedforward fuel delivery control system;

Figure 4A:
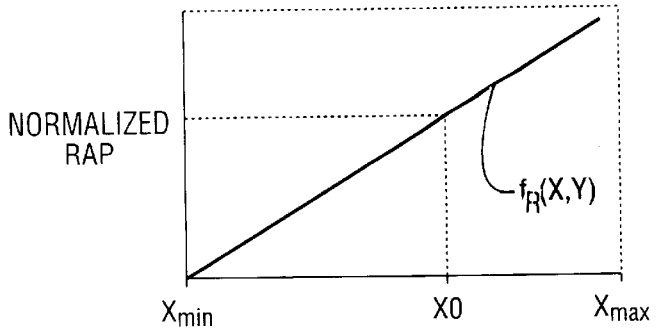
Figure 4B:
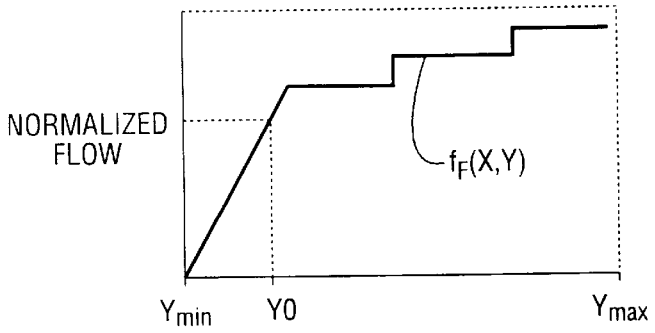
Figure 5:
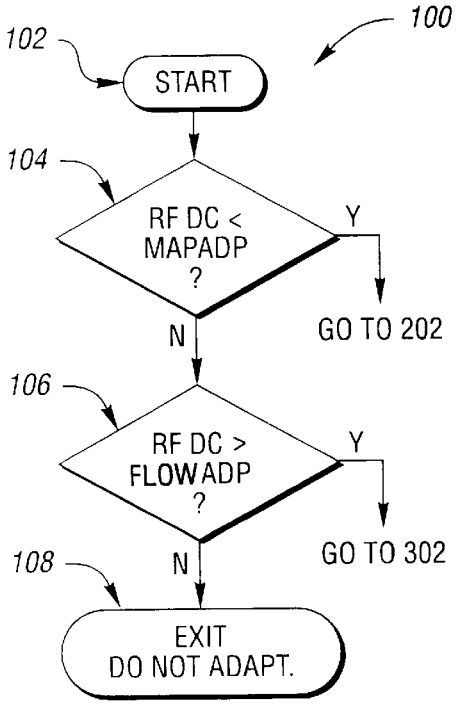
Figure 6:
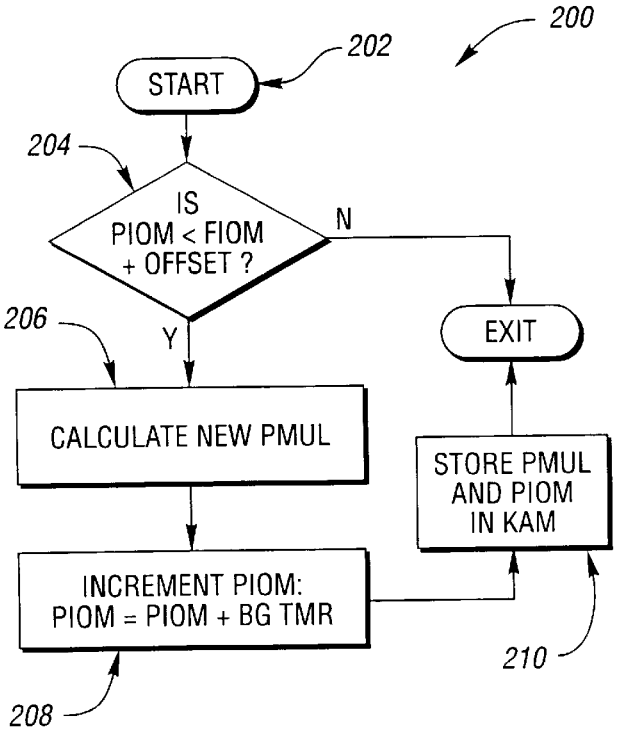
Figure 7:
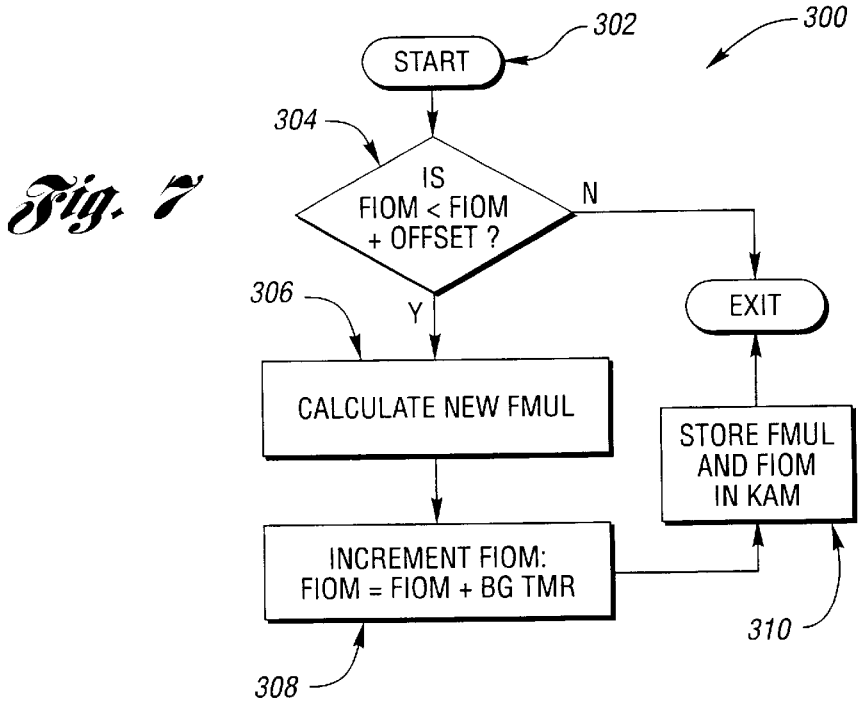
Figure 8:
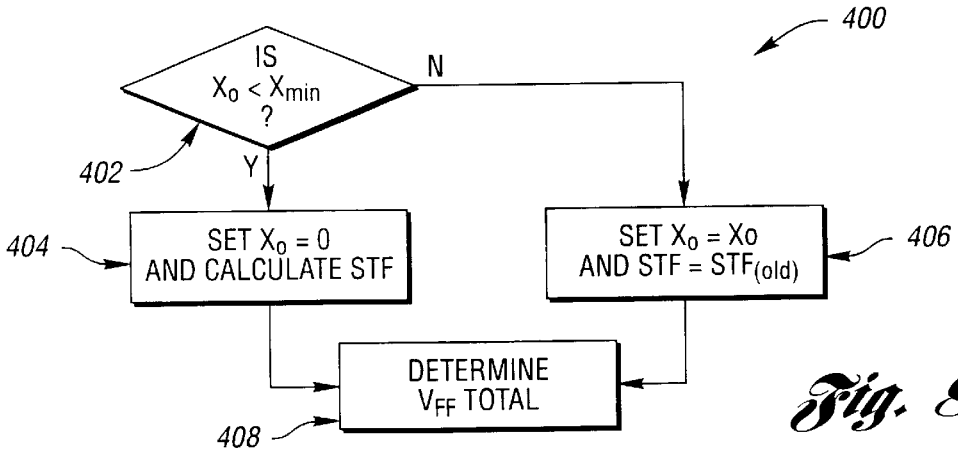
Figure 9:
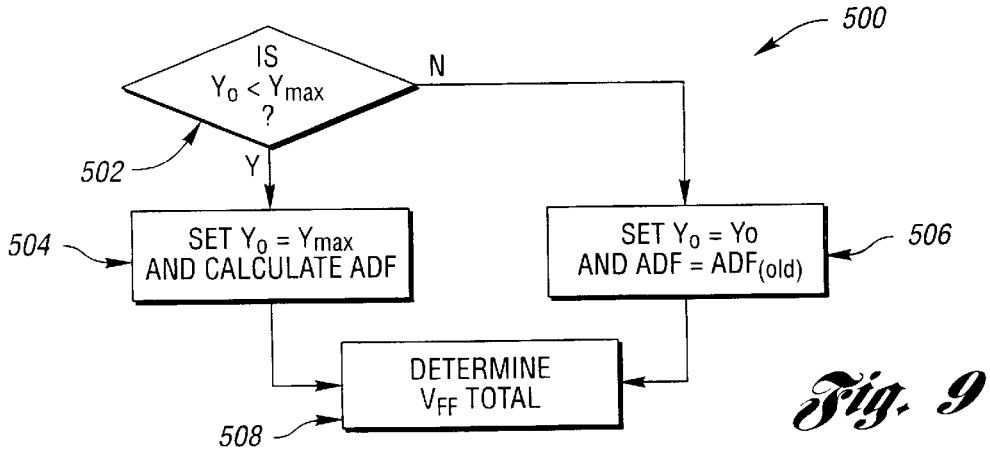

FIGS. 4(*a*) and 4(*b*) are graphs illustrating the adaption of normalized rail absolute pressure and fuel flow in accordance with the present invention;

FIG. 5 is a flow chart illustrating the basic operation of the present invention;

FIG. 6 is a flow chart showing a pressure adapting subroutine of the present invention;

FIG. 7 is a flow chart showing a flowrate adapting subroutine of the present invention;

FIG. 8 is a flow chart showing a downward feedforward voltage adjusting subroutine of the present invention; and FIG. 9 is a flow chart showing an upward feedforward voltage adjusting subroutine of the present invention.

BEST MODE FOR CARRYING OUT THE INVENTION

Figure 1A:
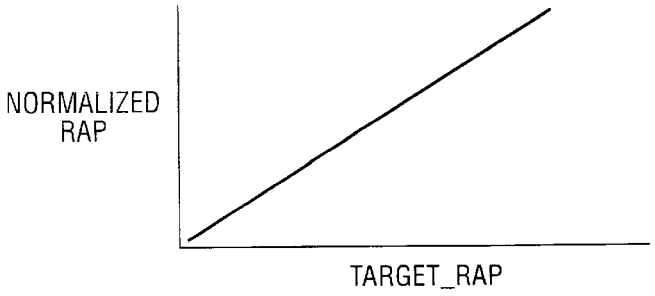
Fig. 1a (PRIOR ART)
Figure 1B:
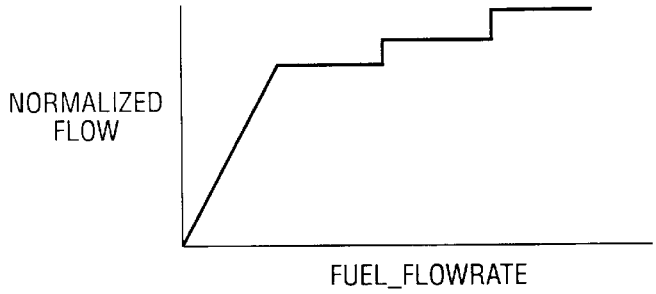
Fig. 1b (PRIOR ART)
Figure 2:
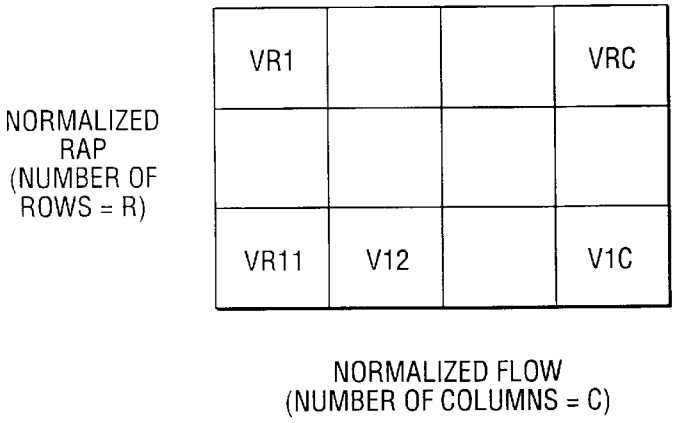
Fig. 2 (PRIOR ART)
FIG. 2 is a matrix illustrating a conventional feedforward voltage look-up table.
Figure 3:
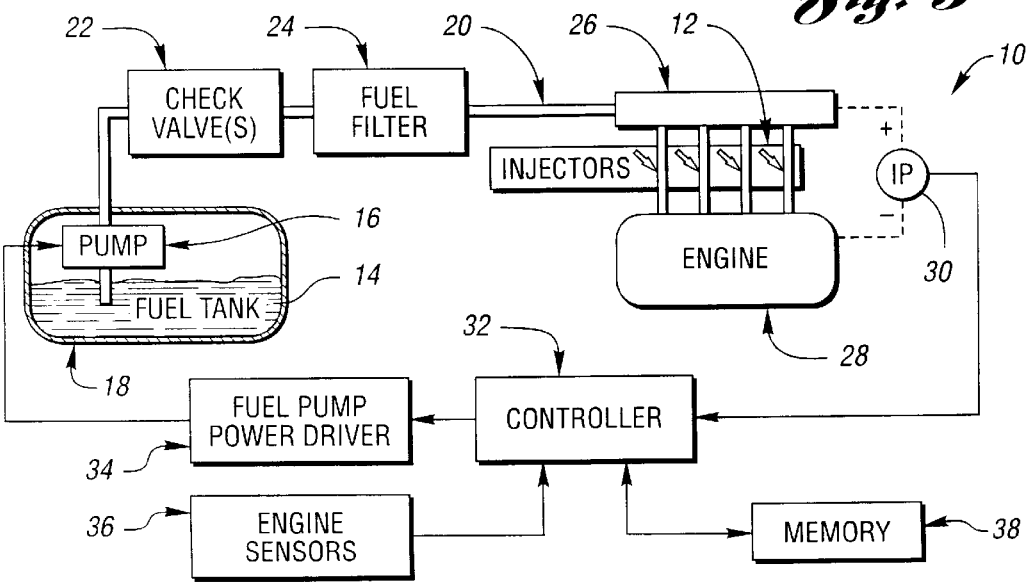
FIG. 3 is a block diagram of a fuel delivery system in accordance with the present invention.

As seen in FIG. 3, a fuel injection delivery system 10 consists of a plurality of fuel injectors 12 which receive fuel 14 from a pump 16 in a fuel tank 18. The fuel 14 is transported from the pump 16 to the injectors 12 via a fuel line 20 through a forward check valve 22, and a filter 24, all leading to a fuel manifold or fuel rail 26.

Pressure across the fuel injectors (IP) is monitored to provide accurate metering of fuel by the injectors into an engine 28. More specifically, IP is measured as the difference in pressure within fuel rail 26 relative to the pressure within an engine intake manifold (not shown). This pressure differential is sensed by a differential pressure sensor denoted as IP sensor 30. An electronic microprocessor-based engine controller 32 modulates the fuel pump 16 via driver 34 in order to achieve an actual target IP value. Controller 32 not only commands the pump input control voltage and reads the IP sensor 30, but is also responsive to other various powertrain actuators and sensors 36. A memory arrangement 38 operates in conjunction with controller 32 for storing data necessary to adapt the feedforward pump voltage. Memory 38 includes at least a keep-alive type memory (KAM), and a ROM.

In accordance with the present invention, adaptive feedforward voltage control is accomplished by adapting the normalized inputs RAP and FLOW used to determine fuel pump input voltage from a look-up table stored in memory 38. More specifically, as described in more detail hereinbelow, normalized RAP is adapted with a pressure multiplier PMUL, and normalized FLOW is adapted with a flow multiplier FMUL, where a pressure index of maturity PIOM and a flow index of maturity FIOM are used to balance the overall adaption process between pressure and flow.

As shown in FIG. 4(*a*), normalized RAP is determined from a function ($f_R(x,y)$) of a desired or target rail absolute pressure (Target RAP) as modified by the pressure multiplier PMUL. More specifically, $X_{max}$ is a predetermined maximum rail pressure, and $X_{min}$ is a predetermined minimum rail pressure for the fuel delivery system 10. Instantaneous value $X_o$ is determined by:

$$X_o = X_{max} - PMUL * (X_{max} - \text{Target RAP}). \quad (1)$$

Normalized RAP is then determined by cross-referencing $X_o$ with f(x,y).

Likewise, as shown in FIG. 4(*b*), normalized FLOW is determined from a function ($f_F(x,y)$) of a desired or target fuel flowrate (Fuel Flowrate) as modified by the flow multiplier FMUL. $Y_{min}$ and $Y_{max}$ are predetermined system flowrate boundaries for the fuel delivery system 10. Instantaneous value $Y_o$ is determined by:

$$Y_o = (\text{Fuel Flowrate}) * (\text{FMUL}). \quad (2)$$

The feedforward voltage (FFVLT) is then determined as a function of normalized RAP and normalized FLOW. More specifically, normalized RAP and FLOW are used as inputs to access a predetermined FFVLT from the aforementioned look-up table stored in memory 38. The feedforward voltage is then supplied to fuel pump 16 via driver 34 to control delivery of the fuel to injectors 12.

FIGS. 5–7 illustrate both a subroutine 100 for controlling the overall adaption in accordance with the present invention, and respective subroutines for generating adaption multipliers PMUL and FMUL.

Referring to FIG. 5, the adaption subroutine 100 starts at block 102 and proceeds to block 104 where controller 32 determines whether the output duty cycle of the fuel pump (RFDC) is less than a calibratable threshold value (MAPADP) for maximum duty cycle necessary to allow adaption based upon sensed manifold absolute pressure (MAP). If RFDC is less than MAPADP, controller 32 will proceed to a pressure adapting subroutine 200 shown in FIG. 6. Otherwise, controller 32 determines at block 106 whether RFDC is greater than a calibratable threshold value (FLOWADP) for minimum duty cycle necessary to allow adaption based upon sensed FUEL FLOWRATE. If RFDC is greater than FLOWADP, controller 32 will proceed to a flowrate adapting subroutine 300 shown in FIG. 7. Otherwise, if neither blocks 104 nor 106 are true, controller 32 exits adaption subroutine 100 at block 108 without adapting either normalized input RAP or FLOW.

With resect to FIG. 5, it is noted that the order or sequence of blocks 104 and 106 has been presented for illustrative purposes only, and is not to be construed as limiting, i.e., the operation steps of blocks 104 and 106 could be reversed so that RFDC is compared to FLOWADP before it is compared with MAPADP.

Referring now to FIG. 6, pressure adapting subroutine 200 starts at block 202 and proceeds to block 204 to determine whether PIOM is less than the sum of FIOM and a calibratable amount of time (OFFSET) that one adaption subroutine will be permitted to exceed the other. Thus, if PIOM is significantly larger than FIOM, controller 32 will exit subroutine 200. Otherwise, a new PMUL is determined at block 206.

PMUL is determined as a ratio of TARGET RAP and a rolling average of the voltage differential between the actual input voltage to fuel pump 16 and a predicted input voltage. More specifically, PMUL is calculated by:

$$\text{PRESS } ERR = (FFVLT - \text{INPUT VLT}) * \text{PSLOPE}; \quad (3)$$

$$\text{ADAPT PRES} = rolav\ (\text{ADAPT PRES, PRESS } ERR,\ TC_p; \quad (4)$$

and $$PMUL = (\text{TARGET RAP} + \text{ADAPT PRESS})/\text{TARGET RAP} \quad (5)$$

where:

PRES ERR=a new instantaneous value of ADAPT PRES, based on the difference between the actual input voltage and the input voltage predicted by the feedforward term;

PSLOPE=a calibratable adjustment and conversion factor for normalized TARGET RAP;

ADAPT PRES=filtered adapted rail pressure; and $TC_p$=a time constant for adaptions based on pressure.

After PMUL is calculated, PIOM is incremented at block 208 by adding the amount of time since the most recent pass through pressure adaptive subroutine 200. Then, the new PMUL and PIOM are stored in a KAM memory at step 210, after which controller 32 exits subroutine 200.

Referring now to FIG. 7, flowrate adapting subroutine 300 starts at block 302 and proceeds to block 304 to determine whether FIOM is less than the sum of PIOM and OFFSET. Controller 32 exits subroutine 300 if FIOM is significantly larger than PIOM. Otherwise, a new FMUL is determined at block 306.

FMUL is determined as a ratio of FUEL FLOWRATE and a rolling average of the voltage differential between the actual input voltage to fuel pump 16 and a predicted input voltage. More specifically, FMUL is calculated by:

$$\text{FLOW } ERR = (\text{INPUT } VLT - FFVLT) * \text{FSLOPE} \quad (6)$$

$$\text{ADAPT FLOW} = rolav\ (\text{ADAPT FLOW, FLOW } ERR, \text{ and } TC_F); (7)$$

and $$FMUL = (\text{FUEL FLOWRATE} + \text{ADAPT FLOW})/\text{FUEL FLOW-}$$

RATE, (8)

where:

FLOW ERR=a new instantaneous value of ADAPT FLOW, based on the difference between the actual input voltage and the input voltage predicted by the feedforward term;

FLSOPE=a calibratable adjustment and conversion factor for normalized FUEL FLOWRATE;

ADAPT FLOW=filtered adapted fuel flow; and $TC_F$=a time constant for adaptions based on flow.

After FMUL is calculated, FIOM is incremented at block 308 by adding the amount of time since the most recent pass through flowrate adapting subroutine 300. Then, the new FMUL and FIOM are stored in a KAM memory at block 310, after which controller 32 exits subroutine 300.

The two respective adaption subroutines 200 and 300 allow system 10 to successfully accommodate a wide range of potential sources of variability in fuel delivery. For example, some sources of variability will predominate at low fuel flowrate/high manifold vacuum. These source include ambient pressure effects, fuel tank pressure effects, and MAP vs. LOAD variability. When these low flow, i.e., low RFDC, conditions exist, adaption subroutine 200 is applied so that the PIOM register increments and PMUL is adapted until PIOM is sufficiently greater than FIOM.

Other sources of variability will predominate at high fuel flowrates. Examples include fuel line clogging, fuel pump deterioration, battery voltage effects, and vehicle-to-vehicle fuel system variability. When these high flow, i.e., high RFDC, conditions exist, adaption subroutine 300 is applied so that the FIOM register increments and FMUL is adapted until FIOM is sufficiently greater than PIOM.

Other variabilities, such as electrical resistance variability, and ambient temperature effects, will be balanced between the two adaption subroutines until appropriate compensation is achieved.

Therefore, the present invention provides a method and system for adaptive control of a fuel delivery system which advantageously only requires four cells of a KAM, i.e., one KAM cell for each of PMUL, FMUL, PIOM, and FIOM, respectively, thereby reducing the cost and complexity of the adaptive control system. In other words, because normalized inputs RAP and FLOW are adapted by PMUL and FMUL, the corresponding feedforward voltage look-up table can be advantageously stored in a ROM instead of KAM.

In further accordance with the present invention, since the feedforward voltage values stored in the look-up table represent a predetermined best guess at the proper input voltage necessary for a given operating point, the use of a finite range of feedforward voltages VRC to minimize the requisite amount of ROM could become problematic if the necessary feedforward voltage either goes above or below the stored range.

To accommodate such a situation, the present invention provides for calculation of two additional adaptive factors, i.e., subroutine 400 as shown in FIG. 8 for subtraction factor STF, and subroutine 500 as shown in FIG. 9 for addition factor ADF. STF and ADF effectively adapt or "stretch" the boundaries of the feedforward voltage look-up table when necessary.

More specifically, for subroutine 400, at block 402 the controller determines whether the current $X_o$, of FIG. 4 (*a*) is less than an $X_{min}$. If $X_o$ is less than $X_{min}$, STF and $X_o$ are calculated at block 404 as follows:

$$STF=V_{11}-(V_{11}/PMUL; \text{ and} \quad (9)$$

$$X_o=\emptyset, \quad (10)$$

where $V_{11}$ is the lowest feedforward voltage stored in the look-up table. Otherwise, as shown at block 406, STF=STF old, and $X_o=X_o$ (note—STF is initially set to 0).

The total adapted feedforward voltage (VFF total) is then determined at block 408 by:

$$VFF \text{ Total}=FFVLT-STF * ((X_{max}-X_o)/X_{max}) \quad (11)$$

Similarly for subroutine 500 in FIG. 9, the controller determines at block 502 whether the current $Y_o$of FIG. 4(*b*) is greater than $Y_{max}$. If $Y_o$ is greater than $Y_{max}$ADF and $Y_o$are calculated at block 504 as follows:

$$ADF=(FMUL)\ (V_{RC})-V_{RC}; \text{ and} \quad (12)$$

$$Y_o=Y_{max},$$

where $V_{RC}$ is the highest feedforward voltage stored in the look-up table. Otherwise, as shown at block 506, ADF= $ADF_{old}$, and $Y_{o=Yo}$ (note—ADF is also initially set to 0).

The total adapted feedforward voltage is then determined at block 508 by:

$$VFF \text{ Total}=FFVLT+ADF * (Y_o/Y_{max}) \quad (13)$$

While the best mode for carrying out the invention has been described in detail, those familiar with the art to which this invention relates will recognize various alternative designs and embodiments for practicing the invention as defined by the following claims.

What is claimed is:

1. A method for controlling fuel supplied by an electronic fuel pump to at least one fuel injector in an internal combustion engine comprises the steps of:

detecting whether fuel flowrate to the at least one fuel injector is less than a first threshold value;

detecting whether fuel flowrate to the at least one fuel injector is greater than a second threshold value;

generating a normalized pressure value and a normalized flowrate value; and determining a fuel pump input voltage based on the normalized pressure value and the normalized flow value; wherein if the first threshold value is not exceeded, generating a pressure modification value and adapting the normalized pressure value based on a target pressure value and the pressure modification value; and if the second threshold value is exceeded, generating a flowrate modification value and adapting the normalized flowrate value based on a target flowrate value and the flowrate modification value.

2. The method of claim 1 wherein said step of generating a pressure modification value comprises the steps of:

determining a pressure adapting value based on a difference between actual input voltage to the fuel pump and a predicted input voltage;

combining the target pressure value with the pressure adapting value; and generating a ratio of the combined target pressure value and pressure adapting value to the target pressure value.

3. The method of claim 2 wherein said step of determining a pressure adapting value comprises the step of averaging a current difference between actual and predicted input voltages with past voltage differences.

4. The method of claim 2 wherein said step of adapting the normalized pressure value comprises the steps of:

subtracting the target pressure value from a maximum allowed pressure value;

multiplying the result of the subtraction step with the generated ratio; and subtracting the result of the multiplication step from the maximum allowed pressure value.

5. The method of claim 2 further comprising the steps of determining an amount of time since the most recent adapting of the normalized pressure value, and incrementing a first maturity index by the determined amount of time.

6. The method of claim 1 wherein said step of generating a flowrate modification value comprises the steps of:

determining a flow adapting value based on a difference between actual input voltage to the fuel pump and a predicted input voltage;

combining the target flowrate value with the flow adapting value; and generating a ratio of the combined target flowrate value and flow adapting value to the target flowrate value.

7. The method of claim 6 wherein the step of determining a flowrate modification value comprises the step of averaging a current difference between actual and predicted input voltages with past voltage differences.

8. The method of claim 6 wherein said step of adapting the normalized flowrate value comprises the step of multiplying the target flowrate value with the generated ratio.

9. The method of claim 6 further comprising the step of determining an amount of time since the most recent adapting of the normalized flow value, and incrementing a second maturity index by the determined amount of time.

10. The method of claim 1 wherein said step of determining an input voltage for the fuel pump comprises utilizing the normalized injector pressure and normalized fuel flowrate values as inputs to select a corresponding voltage from a table stored in a memory.

11. The method of claim 10 further comprising the steps of detecting that the normalized injector pressure is too low to select a voltage from the table, and adjusting the smallest voltage in the table based on the generated pressure modification value.

12. The method of claim 10 further comprising the steps of determining that the normalized fuel flowrate is too high to select a voltage, and adjusting the largest voltage in the table based on the generated flowrate modification value.

13. The method of claim 1 further comprising the steps of tracking a period of time between successive determinations of the pressure modification value, and tracking a period of time between successive determinations of the flowrate modification value.

14. The method of claim 13 wherein a new pressure modification value is only determined if the period of time from the previous determination of the pressure modification value is less than the period of time from the previous determination of the flowrate modification value by a predetermined amount.

15. The system of claim 13 wherein a new flowrate modification value is only determined if the period of time from the previous determination of the flowrate modification value is less than the period of time from the previous determination of the pressure modification value by a predetermined amount.

16. An adaptive feedforward control system for controlling fuel delivery by an electronic fuel pump to at least one fuel injector in an internal combustion engine comprising:

means for detecting pressure at the at lest one fuel injector;

a memory for storing data representative of a plurality of predetermined feedforward voltages, wherein each feedforward voltage corresponds to a first input value based on pressure at the at least one fuel injector, and a second input value based on rate of fuel flow from the fuel pump;

a controller responsive to said detecting means and a target pressure and flowrate for determining the first and second input values, and retrieving the corresponding feedforward voltage from said memory; and a voltage driver responsive to said controller for applying the retrieved feedforward voltage as an input voltage to the fuel pump, wherein said controller further compares a value representative of the fuel pump's output voltage to a pressure adaption threshold value and a fuel flowrate adaption threshold value, and adjusts the first and second input values based on the threshold comparisons.

17. The system of claim 16 wherein said memory comprises a ROM.

18. The system of claim 16 wherein said controller determines a pressure modification value if the pressure adaption threshold value is not exceeded, and determines a flowrate modification value if the fuel flowrate adaption threshold value is exceeded.

19. The system of claim 18 wherein said memory comprises a ROM for storing the plurality of feedforward voltages, and a keep-alive-memory for storing the pressure modification value and the flowrate modification value.

20. The system of claim 18 wherein said controller stores in said memory a value representative of successive determinations of the pressure modification value, and a value representative of a period of time between successive determinations of the flowrate modification value.

* * * * *